US011120726B2

(12) United States Patent
Zhao et al.

(10) Patent No.: US 11,120,726 B2
(45) Date of Patent: Sep. 14, 2021

(54) METHOD AND DEVICE FOR DRIVING DISPLAY PANEL, AND DISPLAY APPARATUS

(71) Applicant: BOE TECHNOLOGY GROUP CO., LTD., Beijing (CN)

(72) Inventors: Hui Zhao, Beijing (CN); Wenjing Tan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/620,977

(22) PCT Filed: May 16, 2019

(86) PCT No.: PCT/CN2019/087283
§ 371 (c)(1),
(2) Date: Dec. 10, 2019

(87) PCT Pub. No.: WO2019/219063
PCT Pub. Date: Nov. 21, 2019

(65) Prior Publication Data

US 2020/0111401 A1 Apr. 9, 2020

(30) Foreign Application Priority Data

May 18, 2018 (CN) ..... 201810478662.8

(51) Int. Cl.
*G09G 5/10* (2006.01)
*G09G 3/20* (2006.01)

(52) U.S. Cl.
CPC ... *G09G 3/2003* (2013.01); *G09G 2300/0413* (2013.01); *G09G 2300/0443* (2013.01);
(Continued)

(58) Field of Classification Search
CPC ..... G09G 3/2003; G09G 2300/0413; G09G 2300/0443; G09G 2320/0233;
(Continued)

(56) References Cited

U.S. PATENT DOCUMENTS

2009/0184994 A1 7/2009 Noguchi et al.
2012/0224766 A1 9/2012 Ohki et al.
(Continued)

FOREIGN PATENT DOCUMENTS

CN 101373575 2/2009
CN 101996597 3/2011
(Continued)

OTHER PUBLICATIONS

International Search Report and Written Opinion dated Aug. 14, 2019 for PCT Patent Application No. PCT/CN2019/087283.
(Continued)

*Primary Examiner* — Jennifer T Nguyen
(74) *Attorney, Agent, or Firm* — Thomas I Horstemeyer, LLP

(57) ABSTRACT

Embodiments of the present disclosure provide a method and device for driving a display panel, and a display device. The display panel includes a first display area having a first pixel density and a second display area having a second pixel density, the second pixel density being greater than the first pixel density. The driving method of the display panel comprises receiving first color gamut input data; converting the first color gamut input data corresponding to the first display area into second color gamut intermediate data; converting the second color gamut intermediate data into first color gamut output data; and converting the first color gamut output data into a driving signal that drives the first display area.

17 Claims, 7 Drawing Sheets

(52) U.S. Cl.
CPC ..... *G09G 2320/0233* (2013.01); *G09G 2320/0666* (2013.01)

(58) Field of Classification Search
CPC ..... G09G 2320/0666; G09G 3/3275; G09G 3/3258; G09G 3/3266; G09G 3/2074; G09G 2320/064
USPC ..... 345/690–694
See application file for complete search history.

(56) References Cited

U.S. PATENT DOCUMENTS

| | | | | |
|---|---|---|---|---|
| 2014/0168185 | A1* | 6/2014 | Han | G06F 3/1446 345/211 |
| 2015/0350619 | A1* | 12/2015 | Nakai | H04N 9/646 348/624 |
| 2016/0191952 | A1 | 6/2016 | Kim et al. | |
| 2017/0116900 | A1 | 4/2017 | Chaji | |
| 2018/0025692 | A1* | 1/2018 | Yata | G02F 1/133621 345/694 |
| 2020/0066809 | A1* | 2/2020 | Liu | G09F 9/33 |

FOREIGN PATENT DOCUMENTS

| | | |
|---|---|---|
| CN | 102655564 | 9/2012 |
| CN | 104332133 | 2/2015 |
| CN | 106921767 | 7/2017 |
| CN | 107564470 | 1/2018 |
| CN | 107610636 | 1/2018 |
| CN | 107844247 | 3/2018 |
| CN | 107871766 | 4/2018 |
| CN | 107920142 | 4/2018 |
| CN | 207264695 | 4/2018 |
| CN | 108648679 | 10/2018 |
| KR | 20180015784 | 2/2018 |
| TW | M568471 | 10/2018 |
| WO | 2019062158 | 4/2019 |

OTHER PUBLICATIONS

1st Office Action dated Dec. 4, 2019 for Chinese Patent Application No. 201810478662.8.
Notice of Allowance dated May 26, 2020 for Chinese Patent Application No. 201810478662.8.

* cited by examiner

METHOD AND DEVICE FOR DRIVING DISPLAY PANEL, AND DISPLAY APPARATUS

CROSS REFERENCE TO RELATED APPLICATIONS

The present application is based upon International Application No. PCT/CN2019/087283, filed on May 16, 2019, which claims the benefit of and priority to Chinese Patent Application No. 201810478662.8, titled "METHOD AND DEVICE FOR DRIVING DISPLAY PANEL, AND DISPLAY DEVICE", filed on May 18, 2018, where the contents of which are incorporated herein by reference in their entireties herein.

TECHNICAL FIELD

The present disclosure relates to the field of display technologies and, in particular, relates to a driving method of display panel, a driving device of a display panel, and a display device.

BACKGROUND

A terminal, such as a smart phone, a PC (personal computer), a notebook PC, and a PDA (Personal Digital Assistant), includes a display for providing an image or video to a user.

Such terminals may include a display function and various functions such as a photographing function, a user identification function, a fingerprint recognition function, and the like. With the development of intelligent communication technology, providing a large screen for picture display has become a new topic.

Currently, the terminal generally has a shooting function. Therefore, it is necessary to set a non-display area for the terminal, and a camera mounting hole is provided in the non-display area to install a camera. It can be seen that, in the case of a fixed terminal size, since it is necessary to provide the non-display area for installing the camera, it is greatly limited to display the large screen of the terminal.

With the development of display electronic products such as mobile phones, the increase of screen-to-body ratio for display screens has become a product trend. The necessary functional components of mobile phones, such as the front camera, has become a major factor limiting the increase of screen-to-body ratio.

It should be noted that the information in the above-described Background is only used to enhance the understanding of the background of the present disclosure, and thus may include the information that does not constitute prior art known to those of ordinary skill in the art.

SUMMARY

According to an aspect of the present disclosure, there is provided a driving method of a display panel, wherein the display panel includes a first display area having a first pixel density and a second display area having a second pixel density, the second pixel density being greater than the first pixel density; the method includes: receiving first color gamut input data; converting the first color gamut input data corresponding to the first display area into second color gamut intermediate data; converting the second color gamut intermediate data into first color gamut output data; and converting the first color gamut output data into a drive signal that drives the first display area.

According to an aspect of the present disclosure, there is provided a driving device of a display panel, wherein the display panel includes a first display area having a first pixel density and a second display area having a second pixel density, the second pixel density being greater than the first pixel density; the driving device includes: an input circuitry, configured to receive first color gamut input data; a first conversion circuitry, configured to convert the first color gamut input data into second color gamut intermediate data corresponding to the first display area; a second conversion circuitry, configured to convert the second color gamut intermediate data into first color gamut output data; and a third conversion circuitry, configured to convert the first color gamut output data into a drive signal that drives the first display area.

According to another aspect of the present disclosure, there is provided a display device including a first display area having a first pixel density and a second display area having a second pixel density, the second pixel density being greater than the first pixel density; and the driving device according to the above embodiment.

In an exemplary embodiment of the present disclosure, there is further provided a camera disposed on the rear side of the display panel, the camera being disposed on a position corresponding to the first display area.

BRIEF DESCRIPTION OF THE DRAWINGS

The various objects, features, and advantages of the present disclosure will become more apparent from the detailed description of the exemplary embodiments by referring to the accompanying drawings. The accompanying drawings are only illustrative of the present disclosure and are not necessarily to scale. The same reference numerals in the drawings denote same or similar components. In the drawings.

DETAILED DESCRIPTION

Figure 1:
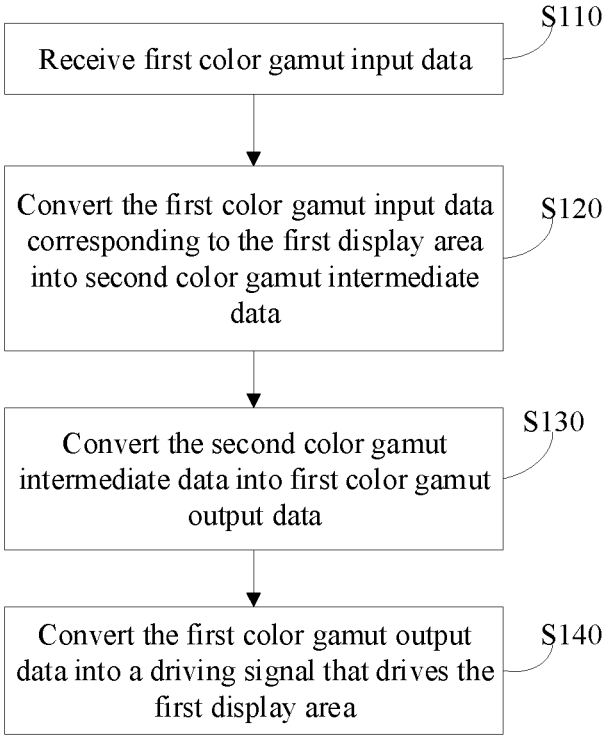
FIG. 1 is a flowchart illustrating a driving method of a display panel according to an embodiment of the present disclosure.

Exemplary embodiments embodying the features and advantages of the present disclosure will be described in detail in the following description. It should be understood that the present disclosure is capable of various modifications in the various embodiments without departing from the scope of the present disclosure, and the description and drawings are only used for illustration but not to limit the present disclosure.

In the following description of the various exemplary embodiments of the present disclosure, by referring to the drawings, the drawings form a portion of the present disclosure and various exemplary structures, systems, and steps that can implement various aspects of the present disclosure are shown by way of examples. It should be understood that the specific solutions of the components, structures, exemplary devices, systems, and steps can be used and perform structural and functional modifications without departing from the scope of the present disclosure.

In order to increase the screen-to-body ratio of display panel, an under-screen-camera is proposed in the related arts, that is, the camera is placed under the screen of display panel. However, if the camera is placed under the screen of display panel, in order to obtain a better imaging effect, the transmittance of the screen needs to be at least 80%, and the pixel density of the screen above the camera needs to be greatly reduced. However, the local pixel density of a local area of the display panel corresponding to the camera is reduced to increase the local screen transmittance, wherein the local area having reduced the local pixel density is referred to as a local transparent area (hereinafter is also referred to as a first display area), and due to the decrease of the pixel density of the transparent area, the brightness of the local transparent area is significantly lower than that of the surrounding area (hereinafter is referred to as the second display area or the normal area).

FIG. 1 is a flowchart illustrating a driving method of a display panel according to an embodiment of the present disclosure.

In the embodiment of the present disclosure, the display panel may include a first display area having a first pixel density and a second display area having a second pixel density, the second pixel density being greater than the first pixel density.

In an exemplary embodiment of the present disclosure, the first display area may include at least one display unit, and each display unit includes at least one first pixel and at least one dummy pixel, and each first pixel includes N sub-pixels and M sub-pixels, wherein N is a positive integer greater than or equal to 1, and M is an integer greater than or equal to zero.

In the following embodiment, an example of N=3, i.e., each first pixel includes three sub-pixels such as a first sub-pixel R, a second sub-pixel G1, and a third sub-pixel B, and M=0 or 1 is taken for illustration, that is, each first pixel only includes a first sub-pixel R, a second sub-pixel G1, and a third sub-pixel B, or each first pixel further includes a fourth sub-pixel (the fourth sub-pixel may be any one of R2, G2, and B2). However, the present disclosure is not limited thereto, and for example, N may be equal to a value of 4 or more, and M may be equal to a value of 2 or more.

In the present disclosure, the "dummy pixels" do not physically have pixels and cannot be used to display information. For example, in FIG. 3, the space defined by the dashed lines in the first display area 310 represents so-called "dummy pixels."

In the embodiment of the present disclosure, the number of first pixels and dummy pixels included in each display unit is determined by the pixel ratio of the first pixel density of the first display area and the second pixel density of the second display area. For example, in the following embodiment, the pixel ratio is 1:4, that is, within a same area, the second display area has four second pixels, and the first display area has one first pixel, in this case, each display unit includes three dummy pixels. However, the present disclosure is not limited thereto, and the specific pixel ratio may be determined according to actual needs.

In an exemplary embodiment of the present disclosure, the second display area includes a plurality of second pixels, and each second pixel includes N sub-pixels.

In the following embodiment, for example, N=3, that is, each second pixel includes three sub-pixels such as a first sub-pixel R, a second sub-pixel G, and a third sub-pixel B. However, the present disclosure is not limited thereto, and for example, N may be equal to a value of 4 or more.

In an exemplary embodiment, the M sub-pixels include at least one green sub-pixel. For example, in FIG. 3, the first pixel of each display unit in the first display area 310 further includes a fourth sub-pixel G2 in addition to a first sub-pixel R, a second sub-pixel G1, and a third sub-pixel B. This is because green has a better effect for enhancement of brightness.

However, the present disclosure is not limited thereto and, for example, the M sub-pixels may further include at least one red sub-pixel (R2) and/or blue sub-pixel (B2).

In an exemplary embodiment, the data lines of the M sub-pixels are respectively connected to any one of idle data channels of the first display area in which the driving chip is located.

When M is not 0, each first pixel in the first display area has M more sub-pixels than each second pixel in the second display area. The data lines of the extra M sub-pixels need to be connected to the data channel of the driver chip to receive the data signal Data sent by the driver chip for displaying image. Because the first pixel density of the first display area is smaller than the second pixel density of the second display area, assuming that the display panel includes n (n is a positive integer greater than or equal to 1) second pixels in each row in the second display area, the driving chip includes n*N data channels, and each data channel and the data line of each sub-pixel of the second pixel in each row has a physically one-to-one connection.

Figure 4:
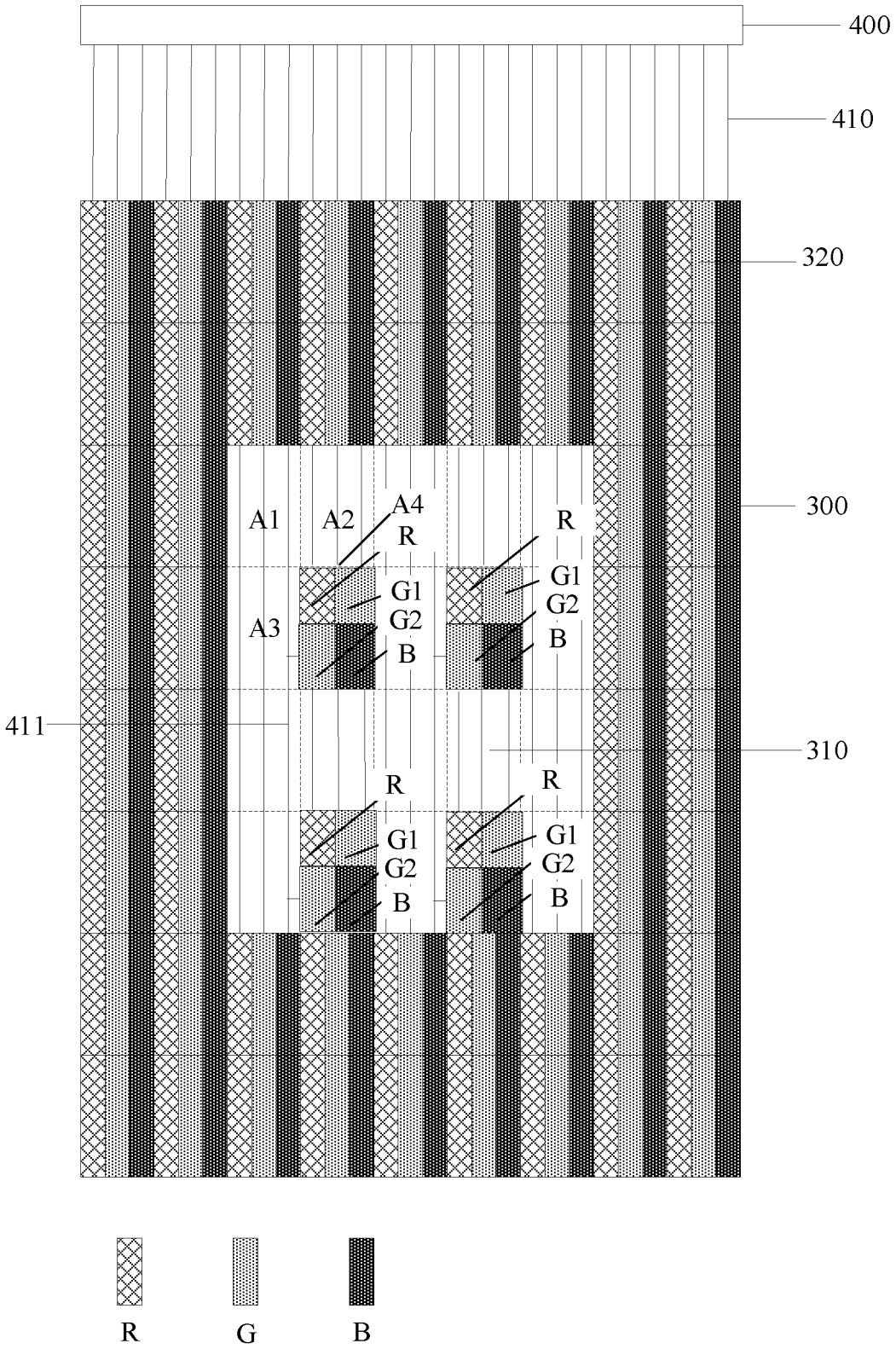
FIG. 4 is a schematic structural diagram of a display device according to the display panel of FIG. 3.

In this case, a portion of data channels corresponding to the first display area is used to physically connect the data lines of the N sub-pixels of the first pixel in each row, and the other portion is referred to as idle data channels. In this case, the data lines of the other M sub-pixels of the first pixel may be physically connected to any one of idle data channels, as shown in FIG. 4, take an example of an display unit composed of A1-A4, the first pixel A4 includes a first sub-pixel R, a second sub-pixel G1, a third sub-pixel B and a fourth sub-pixel G2 and the second pixel includes a first sub-pixel R, a second sub-pixel G and a third sub-pixel B, in this case, for the row corresponding to the first pixel A4 of the first display area 310, there are three idle data channels of three sub-pixels of R, G, and B of the previous second pixel and three idle data channels of three sub-pixels of R, G. and B of the next second pixel. In this case, the data line of the fourth sub-pixel G2 of the first pixel A4 may be physically connected to any one of the three idle data channels of the three sub-pixels of R, G, and B of the previous second pixel and the three idle data channels of the three sub-pixels of R, G, and B of the next second pixel.

In an exemplary embodiment of the present disclosure, the data line of at least one sub-pixel of the M sub-pixels is physically connected to the idle data channel adjacent to the at least one sub-pixel.

In order to reduce the complexity of the physical connection, in the embodiment of the present disclosure, the data line of any one of the M sub-pixels in the first pixel may be physically connected to the idle data channel closest thereto, for example, as shown in FIG. 4, the data line of the fourth sub-pixel G2 of the first pixel A4 is physically connected to the data channel of the driving chip corresponding to the sub-pixel B of the previous second pixel.

As shown in FIG. 1, the driving method of the display device provided in an exemplary embodiment of the present disclosure may include the following steps.

In Step S110, receiving first color gamut input data.

For example, the first color gamut input data is RGB of an input image, but the present disclosure is not limited thereto.

In Step S120, converting the first color gamut input data corresponding to the first display area into second color gamut intermediate data.

For example, the second color gamut intermediate data is YUV, but the present disclosure is not limited thereto.

In an exemplary embodiment, the first display area may include a first display unit, the first display unit including at least one first pixel; the second color gamut intermediate data may include brightness data (Y), first chromaticity data (U), and second chromaticity data (V).

In an exemplary embodiment, converting the first color gamut input data corresponding to the first display area into the second color gamut intermediate data may include: obtaining the brightness data according to the first color gamut input data corresponding to the first display unit; and obtaining the first chromaticity data and the second chromaticity data according to the first color gamut input data corresponding to the at least one first pixel.

In Step S130, converting the second color gamut intermediate data into first color gamut output data.

For example, by processing the RGB of the input image, YUV data corresponding to an output image can be obtained, and then the YUV data corresponding to the output image can be converted into RGB data corresponding to the output image; or by processing the RGB of the input image, YUV data corresponding to an output image can be obtained, and then the YUV data corresponding to the output image is converted into RG1BG2 data corresponding to the output image.

In Step S140, converting the first color gamut output data into a drive signal that drives the first display area.

The driving signal obtained in Step S140 is for driving the first display area of the display panel. Generally, the driving signal may be an LVDS signal (Low-Voltage Differential Signaling). The driving signal is outputted to a TCON (Timer Control Register) of the display panel.

The driving method of the display panel disclosed in the embodiment of the present disclosure can achieve uniform brightness of the entire screen by increasing the brightness of the local transparent area, and solves a technical problem that an obvious dark area is shown and affects the overall visual effect, which is caused by the decrease of the pixel density of the local transparent area in the related arts.

The driving method of the above display panel will be exemplified below with reference to FIG. 2-7.

Figure 2:
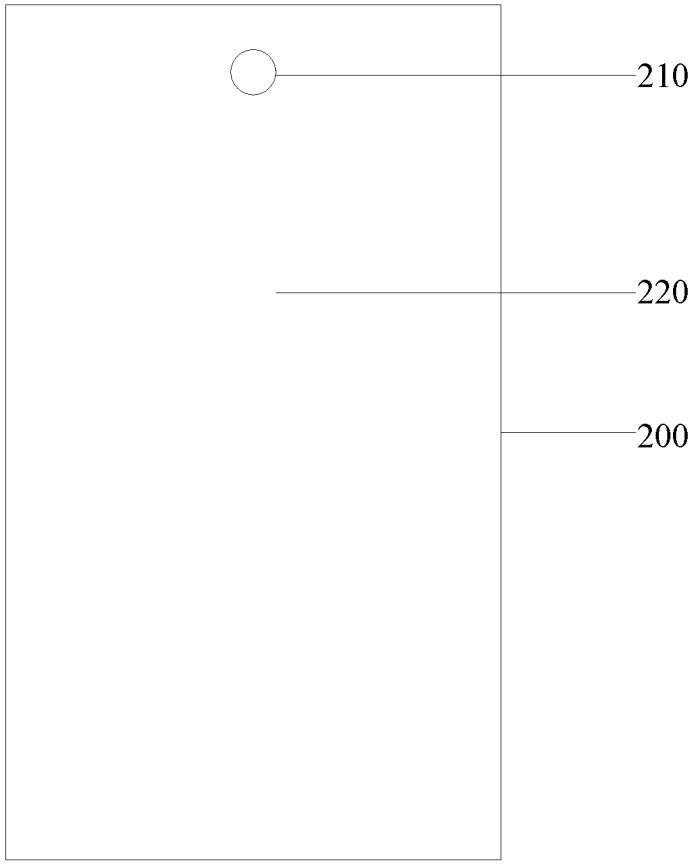
FIG. 2 is a schematic structural diagram of a display panel according to an embodiment of the present disclosure.

FIG. 2 is a schematic structural diagram of a display panel according to an embodiment of the present disclosure.

In the full-screen display technology, when the under-screen-camera solution is adopted, in order to improve the light transmittance of the local area of the display panel corresponding to the camera, the pixel density of the local area of the display panel corresponding to the camera is reduced to achieve local transparency.

As shown in FIG. 2, the display panel 200 provided in the embodiment of the present disclosure may include a first display area 210 and a second display area 220.

The first display area 210 is a transparent area, so that the camera disposed on the rear side of the display panel captures an image through the transparent area.

In the present embodiment, "front" refers to a direction in which the side of the display panel 200 displaying information faces, and "rear" refers to a direction opposite to the "front."

The second display area 220 is a non-transparent area, that is, a normal area, and the non-transparent area may include a display module and a backlight module.

It should be noted that, as shown in FIG. 2, the position relationship between transparent area and normal area is shown. The first display area 210 is disposed at an upper intermediate position of the display panel 200 and is circular, but the present disclosure is not limited thereto. The first display area 210 can be disposed at any suitable position of the display panel 200 according to actual needs, and can be designed in any shape.

In order to improve the picture display quality and simplify the display panel fabrication process, the first display area 210 may be disposed on the top of the display panel 200. In particular, the first display area 210 may be extremely close to the edge of the display panel 200.

In order to facilitate the user to use the terminal camera to shoot, according to the habit of the user using the terminal, as shown in FIG. 2, the first display area 210 is disposed at the middle of the top end of the display panel 200, and the first display area 210 may be extremely close to the edge of the display panel 200.

In other embodiments, the first display area 210 may be disposed at the lateral of the top end of the display panel 200, and the first display area 210 may be extremely close to the edge of the display panel 200.

In order to beautify the display panel, improve the picture display quality, and simplify the display panel fabrication process, the first display area 210 may be disposed at the intersection of the lateral and the top of the display panel 200.

The profile of the first display area 210 may be various, such as one or more of a circular arc shape, a rounded rectangular shape, a rounded square shape, and the like.

Figure 3:
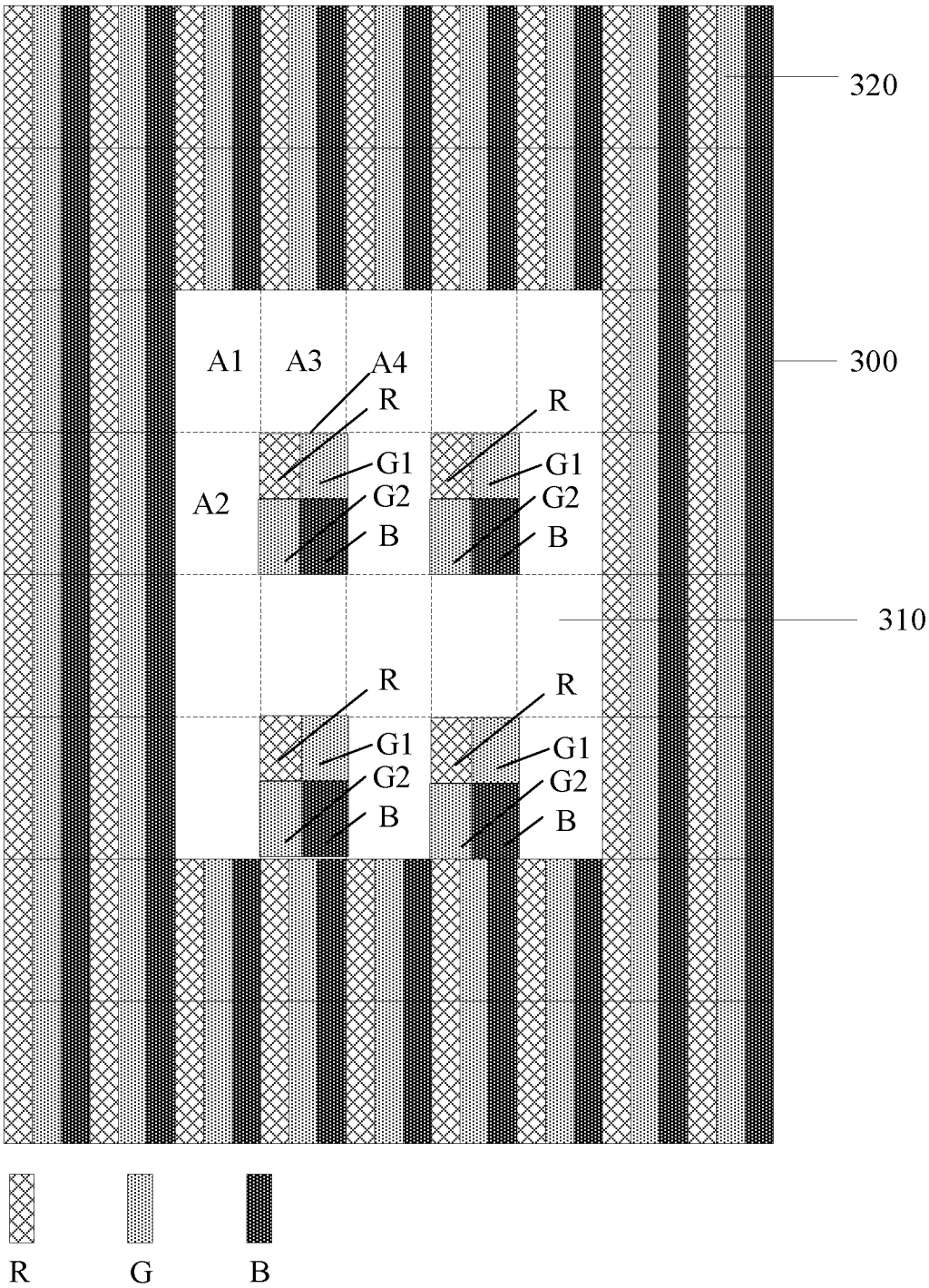
FIG. 3 is a schematic structural diagram of another display panel according to an embodiment of the present disclosure.

FIG. 3 is a schematic structural diagram of another display panel according to an embodiment of the present disclosure.

As shown in FIG. 3, the display panel 300 provided in the exemplary embodiment of the present disclosure may include a first display area 310 and a second display area 320.

The first display area 310 may include at least one display unit, and only four display units are shown for illustrative purposes in FIG. 3, but the present disclosure is not limited thereto. For example, a display unit is composed of A1-A4, wherein A1, A2, and A3 are dummy pixels, and A4 is a first pixel.

In the embodiment shown in FIG. 3, each first pixel includes a first sub-pixel R, a second sub-pixel G1, a third sub-pixel B, and a fourth sub-pixel G2.

Continuing to refer to FIG. 3, the second display area 320 includes a plurality of second pixels, each second pixel including a first sub-pixel R, a second sub-pixel G1, and a third sub-pixel B.

FIG. 3 is a schematic diagram of the first pixel density of the first display area 310 and the second pixel density of the second display area 320. In FIG. 3, the pixel ratio of the first pixel density to the second pixel density is 1:4. When same gray scale is displayed, the number of luminescence pixels in the first display area 310 is only ¼ of that in the second display area 320, so the brightness will have difference of the similar ratios, if no adjustment is made, a dark area appears in the display panel 300 in FIG. 3, and the present disclosure achieves the purpose of improving the brightness of the first display area 310 by adopting the form of RG1BG2 in the first display area 310.

The idea of the present disclosure complies with the human eye vision system quantification, that is, within an area of same size, the human eye is difficult to distinguish the case of lighting up two lights from the case of light up one light with twice brightness, no flicker occurs, and the cost is low.

In the display panel disclosed in the embodiment of the present disclosure, the local transparent area adopts the pixel arrangement of RG1BG2, as shown in FIG. 3, and a G2 sub-pixel is added to increase the brightness of the single pixel, and finally the purpose of increasing the brightness of the local transparent area is achieved. By increasing the brightness of the local transparent area, the uniform brightness of the entire screen can be achieved and a technical problem is solved, which is that in the related arts, due to the decrease of the pixel density of the local transparent area, for the same image, the local transparent area has a lower brightness than that of surrounding areas and an obvious dark area is shown, which affects the overall visual effect.

FIG. 4 is a schematic structural diagram of a display device according to the display panel of FIG. 3.

As shown in FIG. 4, the display device provided by the embodiment of the present disclosure includes a driving device 400 in addition to the display panel shown in FIG. 3 described above. The output end of the driving device 400 is connected to the input end of the display panel 300.

In the embodiment shown in FIG. 4, the driving device 400 includes a plurality of data channels 410 physically connected to the data lines of each sub-pixel (for example, each sub-pixel includes a first sub-pixel R, a second sub-pixel G, and a third sub-pixel B) of the second pixel in each row in the second display area.

The data channels of the plurality of data channels 410 corresponding to the dummy pixels of each row in the first display area 310 are referred to as idle data channels, such as data channel 411.

In the following embodiments, the driving device 400 may be integrated in a driving chip (Driving IC, Integrated Circuit) of a display device, and the driving IC may be used to control information display of the display panel 300. However, the present disclosure is not limited thereto. The driving chip may be disposed in a non-display area of the display device that does not display information.

In an exemplary embodiment, the display device may further include a video input module, which may receive a video file through an HDMI (High Definition Multimedia Interface) receiving port. For example, after processing by an SOC (System-on-a-Chip), the video file is transmitted to the drive device using a Vbyone interface. Alternatively, the image file can be directly transmitted to the drive device.

The display panel 300 is for performing screen display of an electronic file, and the display panel 300 can display information such as images, texts, and the like. The display panel 300 may include a front side that displays information, and a rear side that is located on the opposite side of the front side.

In an exemplary embodiment, the first display area 310 and the second display area 320 may cooperate to display a complete picture. For example, when displaying an image, the first display area 310 can display a portion of the image, and the second display area 320 can display the remaining portion of the image.

In an exemplary embodiment, the first display area 310 may be a transparent display screen having an independent display function. For example, it can be a transparent OLED display screen or an LCD display screen.

In an exemplary embodiment, the display device may further include: a camera disposed on the rear side of the display panel, and the camera is disposed on a position corresponding to the first display area.

When the camera is disposed on the rear side of the first display area 310, the external light signal can enter the light emitting surface of the camera through the first display area 310. When the terminal receives shooting instruction, the camera can sense the light signal emitted by the object, and then performs imaging according to the sensed light signal, thereby capturing an image of the object being photographed.

In order to enable the camera to capture an external image, the first display area 310 is a transparent area. In this way, the external light signal can be incident on the light exit surface of the camera through the transparent first display area 310, and the camera can successfully capture the external image. The transparency of the first display area 310 can be set by a person skilled in the art or a manufacturer.

In the embodiment of the present disclosure, the pixel ratio between the first display area 310 and the second display area 320 may be set according to the transparency of the first display area 310. For example, the higher the transparency required for the first display area 310, the lower the first pixel density of the first display area 310, and the smaller the corresponding pixel ratio, for example, 1:6, 1:8, and the like. Conversely, the lower the transparency required by the first display area 320, the higher the first pixel density of the first display area 320, and the larger the corresponding pixel ratio.

In the embodiment of the present disclosure, the area of the first display area 310 is smaller than the area of the second display area 320. The area of the first display area 310 is related to the size of the light-emitting surface of the camera. For example, the larger the light-emitting surface of the camera, the larger the area of the first display area 310 is set in order to enlarge the camera angle as much as possible.

The driving method of the above display panel will be described below in conjunction with the display device shown in FIG. 4.

The implementation is shown in FIG. 4, the G2 sub-pixel data line of the first pixel of the first display area 310 is physically connected to the B channel 411 of the previous pixel of the second display area 320 of the driving IC. Here, the driving method of the above display panel can be integrated into the driver IC.

When the driving IC detects the first color gamut input data Data of the first display area 310, the conversion from RGB to YUV is performed (here, Y is brightness data, and U and V are first chromaticity data and the second chromaticity data, respectively).

Corresponding to the structure of the display panel 300 shown in FIG. 4, an example of a display unit composed of A1-A4 will be described for illustration. By summing the RGBs (assumed to be RA1, GA1, BA1; RA2, GA2, BA2; RA3, GA3, BA3; RA4, GA4, BA4, respectively) corresponding to A1-A4 in the input data of the first color gamut, a new R' G' B' can be obtained by:

$$R'=RA1+RA2+RA3+RA4$$

$$G'=GA1+GA2+GA3+GA4$$

$$B'=BA1+BA2+BA3+BA4$$

The brightness data Y can be obtained by the following conversion equation:

$$Y=0.30R'+0.59G'+0.11B'$$

Meanwhile, the input RA4, GA4, and BA4 corresponding to the first pixel A4 in the first color gamut input data are converted to obtain the first chrominance data U and the second chrominance data V respectively:

$$YA4=0.30RA4+0.59GA4+0.11BA4$$

$$U=0.493(BA4-YA4)$$

$$V=0.877(RA4-YA4)$$

The above YUV is combined into the second color gamut intermediate data. The YUV is further converted into the first color gamut output data of the four sub-pixels RG1BG2 corresponding to the first pixel A4 by the following equation:

$$\begin{bmatrix} R \\ G1 \\ B \\ G2 \end{bmatrix} = \begin{bmatrix} 1 & 0 & 1.403 \\ 0.5 & -0.172 & -0.357 \\ 1 & 1.770 & 0 \\ 0.5 & -0.172 & -0.357 \end{bmatrix} \cdot \begin{bmatrix} Y \\ U \\ V \end{bmatrix}$$

That is, after the driver IC receives the RGB data corresponding to the first display area 310, the RGB data of each pixel (including dummy pixels and first pixels) in the corresponding display unit is accumulated, and the accumulated RGB is converted to obtain the brightness data Y (about four times greater than the brightness data YA4 of the first pixel, and the specific multiples depends on the pixel ratio, wherein the multiples here is only a rough number and can be fine adjusted as needed after a subjective evaluation of the brightness effect of the display panel) as the brightness data of the first pixel. That is, the brightness of each first pixel in the first display area 310 simultaneously integrates the brightness of the upper, left and upper left dummy pixels and its own brightness while keeping the U and V data corresponding to the first pixel unchanged. That is, by such brightness adjustment, the brightness of the first pixel of the first display area 310 can be adjusted to a level corresponding to the brightness of the second pixel of the normal area, and the brightness of the partial transparent area is improved, so that the local transparent area has the same effect as the brightness of the surrounding area. In the case of the brightness of the local transparent area and the adjacent normal area is tested, when the brightness difference is less than or equal to 4%, the human eye cannot feel the brightness change, and the brightness can be determined to be equivalent, thereby achieving the ultimate goal of uniform brightness of the full screen.

The display device provided by the embodiments of the present disclosure solves the technical problem of uneven brightness of the screen area caused by the under-screen-camera technology in the full screen display technology.

Figure 5:
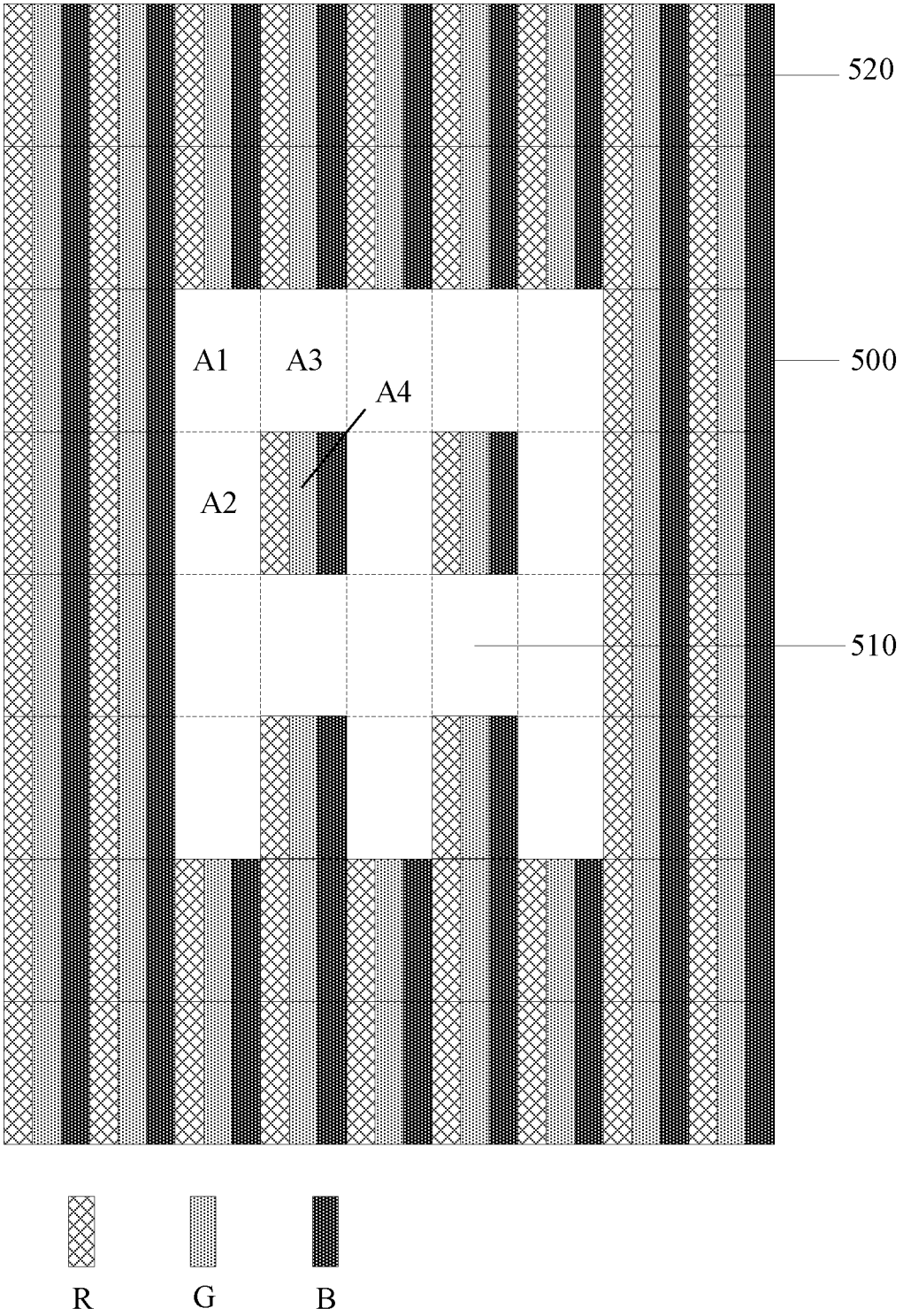
FIG. 5 is a schematic structural diagram of still another display panel according to an embodiment of the present disclosure.

FIG. 5 is a schematic structural diagram of still another display panel according to an embodiment of the present disclosure.

As shown in FIG. 5, the display panel 500 provided by the embodiment of the present disclosure may include a first display area 510 and a second display area 520.

The first display area 510 includes at least one display unit, and is also described by taking a pixel ratio of 1:4 as an example. For example, one display unit is composed of A1-A4, and each display unit includes three dummy pixels A1-A3 and one first pixel A4. Unlike the embodiment shown in FIG. 3, each of the first pixels A4 includes a first sub-pixel R, a second sub-pixel G, and a third sub-pixel B.

The second display area 520 includes a plurality of second pixels, each of the second pixels including a first sub-pixel R, a second sub-pixel G, and a third sub-pixel B.

Figure 6:
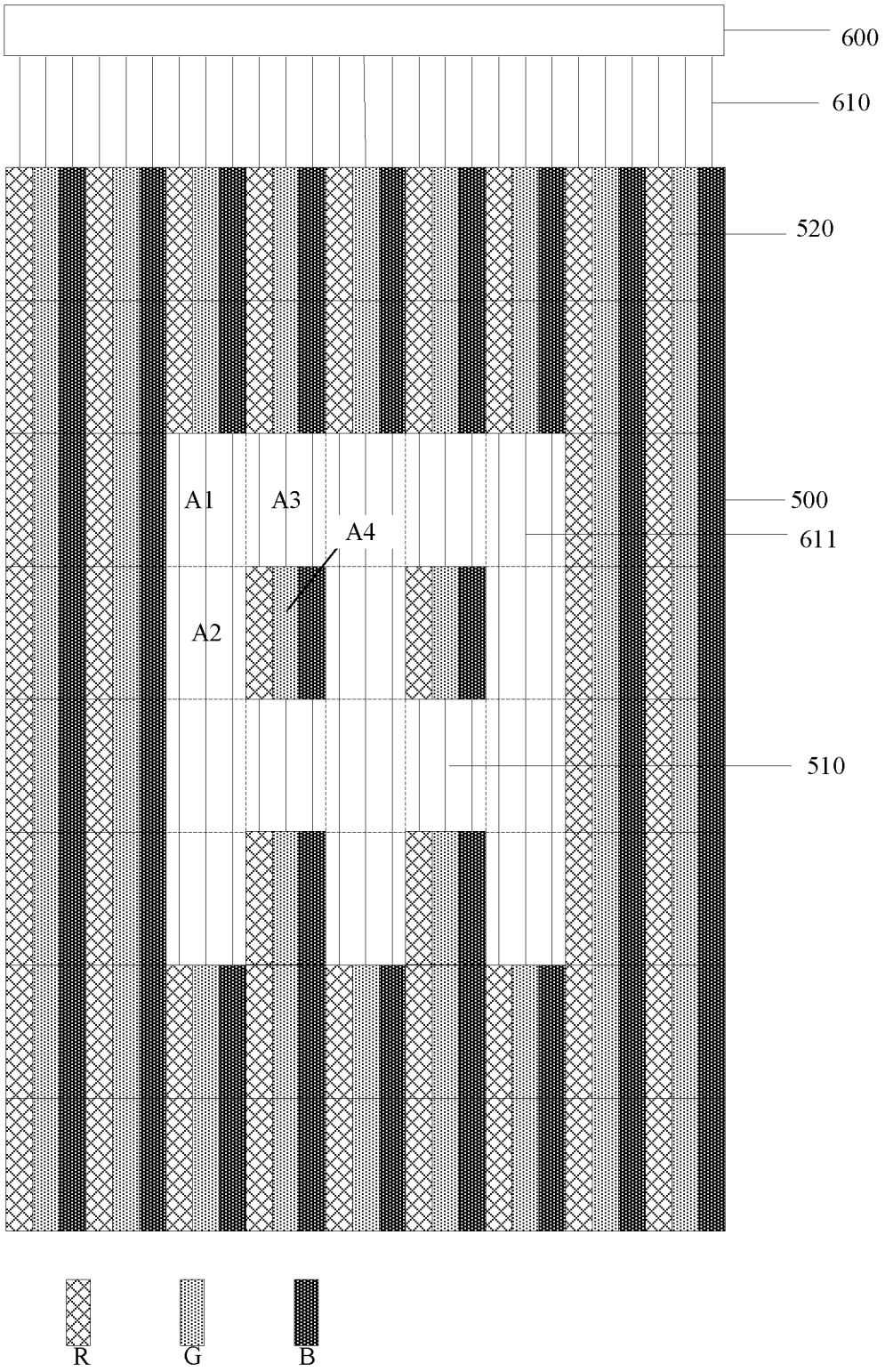
FIG. 6 is a schematic structural diagram of a display device according to the display panel of FIG. 5.

FIG. 6 is a schematic structural diagram of a display device according to the display panel of FIG. 5.

As shown in FIG. 6, the display device provided by the embodiment of the present disclosure further includes a driving device 600 in addition to the display panel shown in FIG. 5. The driving device 600 includes a plurality of data channels 610 electrically connected to each sub-pixel of the second pixel of each row in the second display area 520 respectively.

The data channels corresponding to dummy pixels of each row in the first display area 510 of the plurality of data channels 610 are idle data channels, for example, the idle data channel 611, which is not physically connected to any data line of the sub-pixels in the first display area 510.

In the embodiment shown in FIG. 5 and FIG. 6, the number of sub-pixels of the first pixel in the first display area 510 and the second pixel in the second display area 520 are same, and in this case, there is no unnecessary sub-pixels of the data channel without connecting to the corresponding driving IC. The physical connection between the data lines of the sub-pixels of the first pixel and the idle data channels are not necessary.

The driving method of the above display panel will be described below in conjunction with the display device shown in FIG. 6.

The implementation is as shown in FIG. 6, and the driving method of the above display panel can be integrated into the driving IC for implementation.

When the driver IC detects the first color gamut input data Data of the first display area 510, the conversion from RGB to YUV is performed (here, Y is the brightness data, and U and V are the first chromaticity data and the second chromaticity data, respectively).

Corresponding to the structure of the display panel 500 shown in FIG. 6, an example of a display unit composed of A1-A4 will be described for illustration. By summing the RGBs of four pixels (which are assumed to be RA1, GA1, BA1; RA2, GA2, BA2; RA3, GA3, BA3; RA4, GA4, BA4, respectively) corresponding to A1-A4 in the input data of the first color gamut, a new R' G' B' can be obtained by:

$$R'=RA1+RA2+RA3+RA4$$

$$G'=GA1+GA2+GA3+GA4$$

$$B'=BA1+BA2+BA3+BA4$$

The brightness data Y can be obtained through the following conversion equation:

$$Y=0.30R'+0.59G'+0.11B'$$

Simultaneously, the input RA4, GA4, and BA4 corresponding to the first pixel A4 in the first color gamut input data are converted to obtain the first chromaticity data U and the second chromaticity data V respectively:

$$YA4=0.30RA4+0.59GA4+0.11BA4$$

$$U=0.493(BA4-YA4)$$

$$V=0.877(RA4-YA4)$$

The above YUV is combined into the second color gamut intermediate data. The YUV is further converted into the first color gamut output data corresponding to three sub-pixels RGB of the first pixel A4 by the following equation:

$$\begin{bmatrix} R \\ G \\ B \end{bmatrix} = \begin{bmatrix} 1 & 0 & 1.140 \\ 1 & -0.395 & -0.581 \\ 0.5 & 2.032 & 0 \end{bmatrix} \cdot \begin{bmatrix} Y \\ U \\ V \end{bmatrix}$$

That is, after the driver IC receives the RGB data corresponding to the first display area 310, the RGB data of each pixel (including the dummy pixel and the first pixel) in the corresponding display unit is accumulated, and the accumulated RGB is converted to obtain the brightness data Y (about four times greater than the brightness data YA4 of the first pixel, and the specific multiples depends on the pixel ratio, wherein the multiples here is only a rough number and can be fine adjusted as needed after a subjective evaluation of the brightness effect of the display panel), as the brightness data of the first pixel. That is, the brightness of each first pixel in the first display area 510 simultaneously integrates the brightness of the upper, left and upper left dummy pixels and its own brightness while keeping the U and V data corresponding to the first pixel unchanged. That is, by such brightness adjustment, the brightness of the first pixel of the first display area 510 can be adjusted to a level corresponding to the brightness of the second pixel of the normal area, and the brightness of the partial transparent area is improved, so that the display panel 500 can be reached. The local transparent area has same effect as the brightness of the surrounding area. The brightness of the local transparent area and the adjacent normal area is tested. When the brightness difference is less than or equal to 4%, the human eye cannot detect the brightness change, and the brightness can be determined to be equivalent, thereby achieving the ultimate goal of uniform brightness of the full screen.

Figure 7:
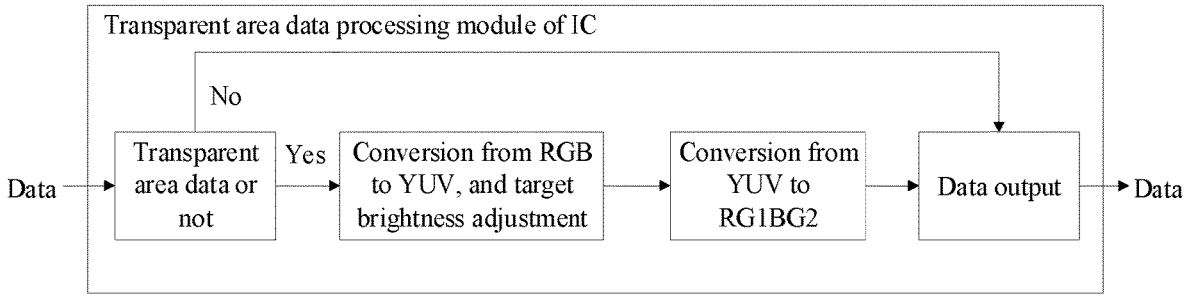
FIG. 7 is a flowchart illustrating still another driving method of a display panel according to an embodiment of the present disclosure.

FIG. 7 is a flowchart illustrating another driving method of a display panel according to an embodiment of the present disclosure.

The driving method of the display panel can be integrated into data processing module of the transparent area of the driving IC, and the data processing module of the transparent area receives the external data to detect whether it is a transparent area data; if it is transparent area data, the conversion from RGB to YUV is performed to adjust target brightness of the transparent area; then the conversion from YUV to RG1BG2 is performed and finally data output is performed to output Data to the transparent area of the display panel for display.

If it is a non-transparent area data, the data output is performed directly.

It should be noted that the display panel structure shown in FIG. 3 and FIG. 5 described above is for illustrative purposes only, and various modifications may be made to the structure of the display panel according to the same inventive concept, for example, the number of the dummy pixels and the first pixels included in each display unit of the first display area, the number of sub-pixels included in each first pixel and arbitrary color selected by each sub-pixel, and the position layout of the first pixel and the dummy pixel; the pixel ratio of the first display area and the second display area; the number of sub-pixels included in the second pixel of the second display area and in the first pixel of the first display area may be same, for example, the second pixel may be RG1BG2, while the first pixel may also be RG1BG2; the number of sub-pixels included in the second pixel of the second display area and in the first pixel of the first display area may be different. When the structure of the display panel described above is modified, the brightness adjustment calculation equation in the driving method of the display panel described above can be changed accordingly.

Figure 8:
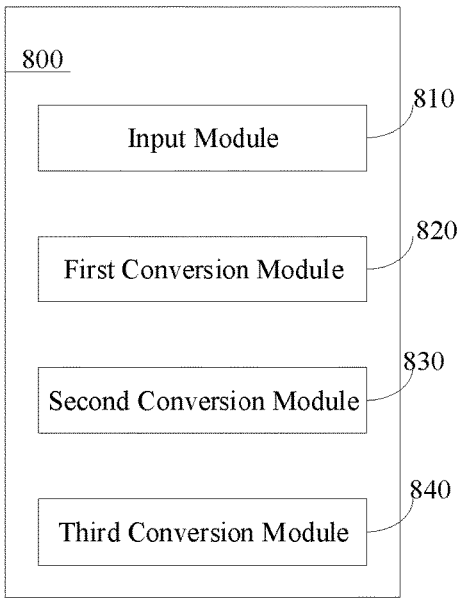
FIG. 8 is a schematic module diagram of a driving device of a display panel according to an embodiment of the present disclosure.

FIG. 8 is a schematic module diagram of a driving device of a display panel according to an embodiment of the present disclosure.

In an embodiment of the present disclosure, the display panel includes a first display area having a first pixel density and a second display area having a second pixel density, the second pixel density being greater than the first pixel density.

As shown in FIG. 8, the driving device 800 of the display panel provided by the embodiment of the present disclosure may include an input module 810, a first conversion module 820, a second conversion module 830, and a third conversion module 840.

The input module 810 can be configured to receive first color gamut input data.

The first conversion module 820 can be configured to convert the first color gamut input data corresponding to the first display area into second color gamut intermediate data.

The second conversion module 830 can be configured to convert the second color gamut intermediate data into first color gamut output data.

The third conversion module 840 can be configured to convert the first color gamut output data into a driving signal that drives the first display area.

In an exemplary embodiment of the present disclosure, the first display area includes at least one display unit, and each display unit includes at least one first pixel and at least one dummy pixel, and each first pixel includes N sub-pixels and M sub-pixels, wherein N is a positive integer greater than or equal to 1, and M is an integer greater than or equal to zero.

In an exemplary embodiment, the second display area includes a plurality of second pixels, each of the second pixels including N sub-pixels.

In an exemplary embodiment, the M sub-pixels include at least one green sub-pixel.

In an exemplary embodiment, the data lines of the M sub-pixels are respectively connected to any one of idle data channels of the first display area in which the driving chip is located.

In an exemplary embodiment, a data line of at least one sub-pixels of the M sub-pixels is connected to an adjacent idle data channel of the at least one sub-pixel.

In an exemplary embodiment, the first display area includes a first display unit, the first display unit including at least one first pixel; and the second color gamut intermediate data includes brightness data, first chromaticity data, and second chromaticity data.

In an exemplary embodiment, the first conversion module 820 may further include: a brightness data obtaining unit, configured to obtain the brightness data according to the first color gamut input data corresponding to the first display unit; a chromaticity data obtaining unit, configured to obtain the first chromaticity data and a second chromaticity data according to first color gamut input data corresponding to the at least one first pixel.

Exemplary embodiments of the driving method of the display panel proposed by the present disclosure are described above and/or illustrated in detail. However, embodiments of the present disclosure are not limited to the specific embodiments described herein, but rather, the components and/or steps of each embodiment can be used independently and separately from the other components and/or steps described herein. Each component and/or each step of an embodiment may also be used in combination with other components and/or steps of other embodiments. When introducing the elements/components/etc. described and/or illustrated herein, the terms "one", "a/an", "the" etc. are used to indicate the presence of one or more elements/components/etc. The terms "including", "comprising" and "having" are used to mean an inclusive meaning and are meant to mean additional elements/components or the like in addition to the listed elements/components/etc. In addition, the terms "first", "second", etc. in the claims and the specification are used only as markers and are not numerical restrictions on their objects.

Although the driving method of the display panel proposed by the present disclosure has been described in terms of various specific embodiments, those skilled in the art will recognize that the implementation of the present disclosure may be modified within the spirit and scope of the claims.

What is claimed is:

1. A driving method of a display panel, comprising:

providing the display panel, wherein the display panel comprises a first display area having a first pixel density and a second display area having a second pixel density, the second pixel density being greater than the first pixel density;

receiving red-green-blue (RGB) input data that comprises red data R, green data G, and blue data B;

converting, by a first conversion circuit, the RGB input data corresponding to the first display area into YUV intermediate data, the YUV intermediate data comprising brightness data Y, first chromaticity data U, and second chromaticity data V according to the following equations:

$$Y=0.30R+0.59G+0.11B;$$

$$U=0.493(B-Y); \text{ and}$$

$$V=0.877(R-Y);$$

converting, by a second conversion circuit, the YUV intermediate data into RGB output data according to the following equation:

$$\begin{bmatrix} R \\ G \\ B \end{bmatrix} = \begin{bmatrix} 1 & 0 & 1.140 \\ 1 & -0.395 & -0.581 \\ 0.5 & 2.032 & 0 \end{bmatrix} \cdot \begin{bmatrix} Y \\ U \\ V \end{bmatrix}; \text{ and}$$

converting, by a third conversion circuit, the RGB output data into a drive signal that drives the first display area.

2. The driving method of the display panel according to claim 1, wherein:

the first display area comprises at least one display unit;

each display unit comprises at least one first pixel and at least one dummy pixel; and each first pixel comprises N first sub-pixels and M second sub-pixels, wherein N is a positive integer greater than or equal to 1, and M is an integer greater than or equal to zero.

3. The driving method of the display panel according to claim 2, wherein the M second sub-pixels comprise at least one green sub-pixel.

4. The driving method of the display panel according to claim 2, wherein data lines of the M second sub-pixels are respectively connected to any one of a plurality of idle data channels of the first display area in which a driving chip is located.

5. The driving method of the display panel according to claim 2, wherein a data line of at least one sub-pixel of the M second sub-pixels is connected to one of the idle data channels adjacent to the at least one second sub-pixel.

6. The method according to claim 2, wherein the converting of the RGB input data corresponding to the first display area into the YUV intermediate data comprises:

for each display unit in the first display area, accumulating RGB data of the at least one first pixel and the at least one dummy pixel; and converting resulting RGB data into second gamut data of the at least one first pixel to obtain the YUV intermediate data.

7. The driving method of the display panel according to claim 1, wherein the second display area comprises a plurality of second pixels, each of the second pixels comprising N third sub-pixels.

8. The driving method of the display panel according to claim 1, wherein:

the first display area comprises a first display unit, the first display unit comprising at least one first pixel; and the YUV intermediate data comprises brightness data, first chromaticity data, and second chromaticity data;

the converting of the RGB input data corresponding to the first display area into the YUV intermediate data comprises:

obtaining the brightness data according to the RGB input data corresponding to the first display unit; and obtaining the first chromaticity data and the second chromaticity data according to the RGB input data corresponding to the at least one first pixel.

9. A driving device of a display panel, wherein the display panel comprises a first display area having a first pixel density and a second display area having a second pixel density, the second pixel density being greater than the first pixel density, wherein the driving device comprises:

an input circuitry configured to receive red-green-blue (RGB) input data that comprises red data R, green data G, and blue data B;

a first conversion circuitry configured to convert the RGB input data corresponding to the first display area into YUV intermediate data, the YUV intermediate data comprising brightness data Y, first chromaticity data U, and second chromaticity data V according to the following equations:

$$Y=0.30R+0.59G+0.11B;$$

$$U=0.493(B-Y); \text{ and}$$

$$V=0.877(R-Y);$$

a second conversion circuitry configured to convert the YUV intermediate data into RGB output data according to the following equation:

$$\begin{bmatrix} R \\ G \\ B \end{bmatrix} = \begin{bmatrix} 1 & 0 & 1.140 \\ 1 & -0.395 & -0.581 \\ 0.5 & 2.032 & 0 \end{bmatrix} \cdot \begin{bmatrix} Y \\ U \\ V \end{bmatrix}; \text{ and}$$

a third conversion circuitry configured to convert the RGB output data into a driving signal that drives the first display area.

10. The driving device of the display panel according to claim 9, wherein:

the first display area comprises at least one display unit;

each display unit comprises at least one first pixel and at least one dummy pixel; and each first pixel comprises N first sub-pixels and M second sub-pixels, wherein N is a positive integer greater than or equal to 1 and M is an integer greater than or equal to zero.

11. The driving device of the display panel according to claim 10, wherein the M second sub-pixels comprise at least one green sub-pixel.

12. The driving device of the display panel according to claim 10, wherein data lines of the M second sub-pixels are respectively connected to any one of a plurality of idle data channels of the first display area in which a driving chip is located.

13. The driving device of the display panel according to claim 10, wherein a data line of at least one second sub-pixel of the M second sub-pixels is connected to one of the idle data channels adjacent to the at least one second sub-pixel.

14. The driving device of the display panel according to claim 10, wherein the first conversion circuitry is further configured to:

for each display unit in the first display area, accumulate RGB data of the at least one first pixel and the at least one dummy pixel; and convert resulting RGB data into second gamut data of the at least one first pixel to obtain the YUV intermediate data.

15. The driving device of the display panel according to claim 9, wherein the second display area comprises a plurality of second pixels, each of the second pixels comprising N third sub-pixels.

16. A display device, comprising:

a display panel comprising a first display area having a first pixel density and a second display area having a second pixel density, the second pixel density being greater than the first pixel density; and a driving device, comprising:

an input circuitry configured to receive red-green-blue (RGB) input data comprising red data R, green data G, and blue data B;

a first conversion circuitry configured to convert the RGB input data corresponding to the first display area into YUV intermediate data, the YUV intermediate data comprising brightness data Y, first chromaticity data U and second chromaticity data V, according to the following equations:

$$Y=0.30R+0.59G+0.11B;$$

$$U=0.493(B-Y); \text{ and}$$

$$V=0.877(R-Y);$$

a second conversion circuitry configured to convert the YUV intermediate data into RGB output data according to the following equation:

$$\begin{bmatrix} R \\ G \\ B \end{bmatrix} = \begin{bmatrix} 1 & 0 & 1.140 \\ 1 & -0.395 & -0.581 \\ 0.5 & 2.032 & 0 \end{bmatrix} \cdot \begin{bmatrix} Y \\ U \\ V \end{bmatrix}; \text{ and}$$

a third conversion circuitry configured to convert the RGB output data into a driving signal that drives the first display area.

17. The display device according to claim 16, further comprising a camera disposed on a rear side of the display panel, wherein the camera is disposed on a position corresponding to the first display area.

* * * * *